United States Patent [19]

Likhogub et al.

[11] 4,416,733

[45] Nov. 22, 1983

[54] DRY QUENCHING APPARATUS FOR HOT COKE

[75] Inventors: Evgeny P. Likhogub; Stanislav S. Sergeev; Alexandr N. Minasov, all of Kharkov, U.S.S.R.

[73] Assignee: Giprokox, Kharkov, U.S.S.R.

[21] Appl. No.: 389,149

[22] Filed: Jun. 16, 1982

[51] Int. Cl.[3] ..... C10B 39/00; C10B 39/02

[52] U.S. Cl. ..... 202/228; 201/39

[58] Field of Search ..... 202/228, 270; 201/39

[56] References Cited

U.S. PATENT DOCUMENTS

| | | | |
|---|---|---|---|
| 1,545,060 | 7/1925 | Moetteli | 202/228 |
| 4,024,023 | 5/1977 | Jonnet | 201/39 |
| 4,141,795 | 2/1979 | Koizumi et al. | 201/39 |
| 4,212,706 | 7/1980 | Koizumi et al. | 201/39 |
| 4,264,415 | 4/1981 | Galow et al. | 202/228 |
| 4,282,069 | 8/1981 | Minasov et al. | 201/39 |

FOREIGN PATENT DOCUMENTS

| | | | |
|---|---|---|---|
| 41941 | 12/1981 | European Pat. Off. | 201/39 |
| 54-50478 | 4/1979 | Japan | 202/228 |
| 54-50479 | 4/1979 | Japan | 202/228 |
| 473741 | 11/1975 | U.S.S.R. . | |
| 798158 | 1/1981 | U.S.S.R. | 202/228 |

*Primary Examiner*—Bradley Garris

*Attorney, Agent, or Firm*—Ladas & Parry

[57] ABSTRACT

A dry quenching apparatus for hot coke has an upright housing having openings for charging and discharging the coke. An annular header for exhausting gases from the quenching zone is arranged in the middle portion of the housing. In the lower portion of the housing there is an annular header for supplying a cooling agent and communicating through corresponding passages with a distributor disposed above the annular header for supplying a cooling agent and centrally of the housing. An annular distribution header is arranged above the annular header for supplying a cooling agent and has vertical partition walls dividing the distribution header into sections. Each section has at least one opening through which the annular header for supplying gases and the annular distribution header communicate. At least one opening in each section accommodates a flow governor for a cooling agent.

1 Claim, 3 Drawing Figures

DRY QUENCHING APPARATUS FOR HOT COKE

FIELD OF THE INVENTION

The invention relates to coke production and more particularly to dry quenching apparatus for hot coke.

DESCRIPTION OF THE PRIOR ART

The grade of coke supplied to customers is greatly dependent on that how uniformly coke is quenched in the apparatus for dry quenching of hot coke. The main factor responsible for uniformity of quenching is the distribution of a cooling agent, such as an inert gas, in the quenching zone (quenching chamber) according to output variations, the coke's shift distribution (descent) throughout the quenching zone and the uniformity of gas removal from the quenching zone. However, heretofore this problem has not been adequately solved.

An example of the dry quenching apparatus for hot coke is found in Soviet Inventor's Certificate No. 473,741, which apparatus comprises an upright housing having openings for charging and discharging coke. In the middle portion of the housing and above the quenching zone there is provided an annular header for exhausting gases which header is made in the form of an annular passage in the housing body and communicating with the quenching zone through branch passages and carrying the gas out of the apparatus through one branch passage.

The apparatus also comprises a gas input arrangement including an annular header for supplying the cooling agent into the quenching zone and arranged in the lower portion of the housing, a distribution header arranged above the annular header and communicating therewith through openings and further including a centrally disposed blowing column.

To achieve a more uniform quenching of the boundary layer of the coke in the above apparatus the gases from the quenching zone are removed through radial branch passages of the annular header equidistantly spaced along the perimeter of the housing.

The gases, however, are drawn off the annular header in one direction only. That is why the gas is evacuated from the annular header at a faster rate in the location of suction than from the opposite side and, consequently, the gas supplied into the quenching zone is passed through the coke body substantially in the direction of suction, which results in a nonuniform quenching of coke. The tests show that the temperature of the coke on the opposite side of the quenching chamber is higher from 50° to 70° C. in the lower portion of the chamber and from 150° to 200° C. in the upper portion.

A uniform removal of gas from the quenching chamber is achieved in a dry quenching apparatus for hot coke disclosed in Soviet Inventor's Certificate No. 582,674 and comprising, as with the apparatus hereinbefore discussed, an upright housing having openings for charging and discharging coke, an annular header for removing gas and a similar gas input means.

The annular header for removing gas has an annular passage communicating with the chamber through radial gas removing passages provided in the housing above the quenching chamber. A distinguishing feature of that apparatus is that the passage of the header for removing gases is divided along its vertical extent into two gas passages by a horizontally extending partition having openings for communication between the gas passages thereby providing for a uniform removal of gases from the quenching chamber.

Such an annular header for removing gases makes laying of the housing somewhat complicated.

Moreover, despite a uniform gas removal, the problem of a uniform quenching of coke is but partially solved inasmuch as the uniform quenching may be achieved by a uniform supply of gas under invariable process conditions or by redistribution of the gas in the quenching zone if desired, i.e., when the output is changed as well as in the case of change in configuration and dimensions of the annular headers and the openings providing for their intercommunication, which change will result in a nonuniform distribution of the cooling agent in the annular passages of these headers and, consequently, in a nonuniform supply into the quenching zone.

SUMMARY OF THE INVENTION

A general object of the invention is to provide a dry quenching apparatus for hot coke wherein the gas distributor ensures a uniform quenching of the coke in the quenching zone.

Another but still as important object of the invention is simplified assembly of the housing.

A further important object of the invention is the production of a higher grade coke.

These and other objects of the invention are attained by providing a dry quenching apparatus for hot coke, comprising an upright housing having openings for charging and discharging the coke, an annular header for supplying a cooling agent arranged in the lower portion of the housing, a centrally disposed distributor for the cooling agent communicating with the annular header, a distribution header arranged above the annular header for supplying the cooling agent and communicating with the latter through openings, and an exhaust header for gases arranged in the middle portion of the housing, wherein according to the invention the distribution header is provided with vertical partition walls dividing the same header into sections each including at least one opening and with flow governors for the cooling agent, which governors are installed at least in one of the openings in each section providing communication of a corresponding section of the distribution header with the annular header for supplying the cooling agent.

BRIEF DESCRIPTION OF THE DRAWINGS

The invention will be described further, by way of example, with reference to the accompanying drawings, in which.

DETAILED DESCRIPTION OF THE INVENTION

Figure 1:
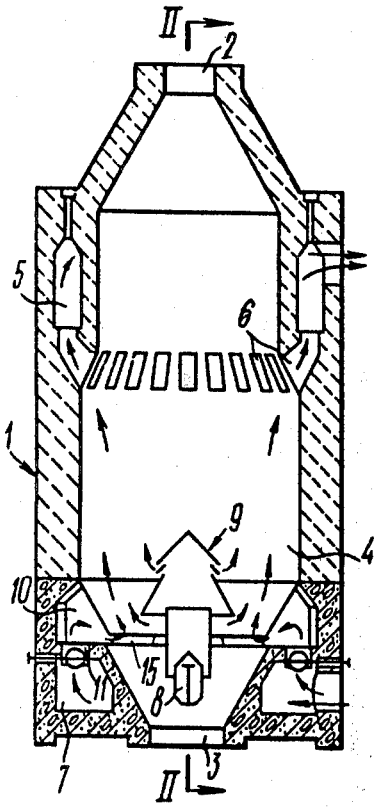
FIG. 1 is a diagrammatical view, in longitudinal section, of a dry quenching arrangement for hot coke embodying the invention.
Figure 2:
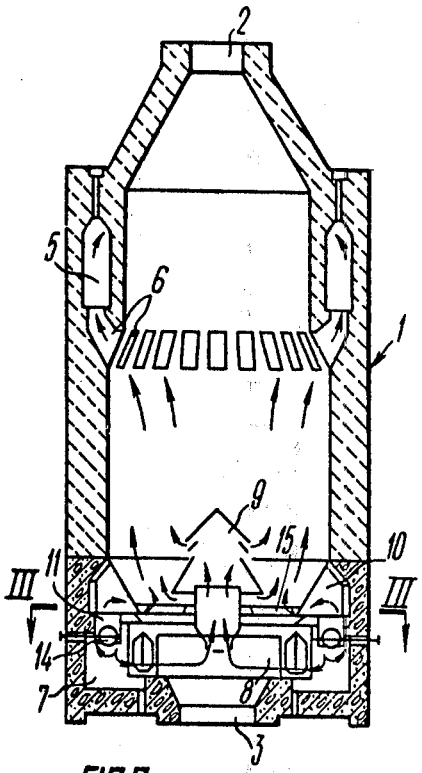
FIG. 2 is a sectional view of the dry quenching arrangement for hot coke taken on the line II—II in FIG. 1.

Referring to FIGS. 1 and 2, a dry quenching apparatus for hot coke comprises an upright housing 1 having openings 2 and 3 for respectively charging and discharging the coke. In the middle portion of the housing 1 and above the coke quenching zone 4 there is provided an annular header 5 for removing or exhausting gases from the quenching zone 4 through the gas passages 6. In the lower portion of the housing 1 there are provided an annular header 7 for supplying a cooling agent communicating through a gas supplying duct 8 with a centrally disposed distributor 9 (blowing column) and a distribution header 10 arranged above the annular header 7 for supplying the cooling agent and communicating with the latter through openings 11.

Figure 3:
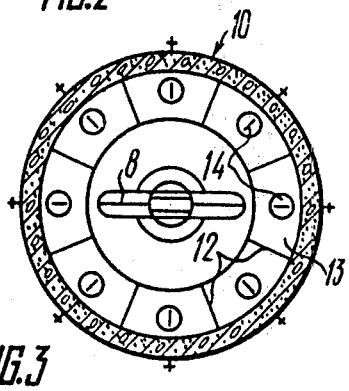
FIG. 3 is a sectional view of the dry quenching arrangement for hot coke taken on the line III—III in FIG. 2.

In order to supply a cooling agent in accordance with the process variables, for example, an output, uneven distribution of the coke in the quenching zone as well as uneven distribution of the cooling agent in the annular headers 7 and 10 for supplying the same, which results from acceptable deviations of the headers as to shape and dimensions and a possible non-similarity of the openings 11, through which the headers communicate with each other, the distribution header 10 is provided with vertical partition walls 12 (see FIG. 3), which divide the header 10 into sections 13 each of which has an opening 11, with flow governors 14 for the cooling agent installed in each opening 11, which opening makes for communication of each section 13 of the distribution header 10 with the annular header 7 for supplying the cooling agent.

A section 13 may have a plurality of openings, of which at least one may include a flow governor for the cooling agent. The most effective method of controlling gas supply, however, is when each section 13 is associated with a corresponding opening 11 and when a flow governor is provided in all the openings in each section.

A throttle valve such that the adjusting screw thereof extends through the housing 1 outside the quenching apparatus may be used as the flow governor 14, which makes it possible to automatically control cooling agent supply to the quenching apparatus.

The dry quenching apparatus for hot coke operates as follows.

Incandescent coke is charged through the filling opening 2 into the housing 1 for quenching by a cooling agent, such as an inert gas, circulating in a closed-circuit flow. The cooling gas is supplied into the lower annular header 7 to be conducted through the gas supply duct 8 into the centrally disposed distributor 9 and further through the openings 11 where the flow governors 14 for the cooling agent are installed. It then flows to the sections 13 of the distribution header 10.

From the section 13 of the distribution header 10 through a slot 15 and from the centrally disposed distributor the cooling gas is passed through the coke body in a counter-flow movement. The hot gas is withdrawn through the gas passages 6 and the annular header 5 to a dust-settler and further on to waste-heat boiler (not shown).

Distribution of the cooling gas in the quenching zone is controlled according to temperature sensors (thermocouple) installed into the housing on the perimeter thereof level with the quenching zone 4. If a deviation of the temperature of the controlled section occurs the cooling agent supply to a corresponding section 13 of the distribution header 10 is adjusted and the cooling gas introduced at a desired flow rate, without uncontrolled spread out throughout the header 10, into that section of the quenching zone 4 where the temperature deviation has been sensed.

The above procedure provides a desired supply of the cooling gas into the quenching zone 4 to create conditions for a uniform quenching of the coke and to increase output under existing process conditions.

Also, such a controlled supply of the cooling gases makes it possible to distribute the gas on the perimeter of the housing in the quenching zone so that uneven cooling be eliminated, which heretofore was the result of an uneven and unidirectional evacuation of the chamber, without effecting additional changes in the design of the annular exhaust header for gases, i.e., to increase the gas flow on the side opposite to that where the gas is evacuated and thereby do away with the difficulties in assembly the housing.

What is claimed is:

1. A dry quenching apparatus for hot coke comprising:

an upright housing having openings for charging and discharging the coke, an annular header for supplying a cooling agent and arranged in the lower portion of said housing, a centrally disposed distributor for the cooling agent arranged in the lower portion of said housing and communicating with said annular header for supplying the cooling agent, a distribution header arranged above said annular header for supplying the cooling agent and communicating with the annular header through openings, vertical partition walls arranged in said distribution header and defining sections therein, each section including at least one said opening whereby said headers communicate with each other, flow governors for the cooling agent each arranged in at least one said opening in each section, and an annular exhaust header for gases arranged in the middle portion of the housing.

* * * * *